US008147919B2

(12) United States Patent
Chilla et al.

(10) Patent No.: US 8,147,919 B2
(45) Date of Patent: Apr. 3, 2012

(54) PROCESS FOR THE PRODUCTION OF MULTI-LAYER COATINGS

(75) Inventors: Marc Chilla, Sprockhoevel (DE); Marcus Brunner, Wuppertal (DE)

(73) Assignee: E I du Pont de Nemours and Company, Wilmington, DE (US)

( * ) Notice: Subject to any disclaimer, the term of this patent is extended or adjusted under 35 U.S.C. 154(b) by 346 days.

(21) Appl. No.: 12/446,119

(22) PCT Filed: Sep. 25, 2007

(86) PCT No.: PCT/US2007/020701

§ 371 (c)(1),
(2), (4) Date: Apr. 17, 2009

(87) PCT Pub. No.: WO2008/051345

PCT Pub. Date: May 2, 2008

(65) Prior Publication Data

US 2010/0323120 A1 Dec. 23, 2010

Related U.S. Application Data

(60) Provisional application No. 60/854,270, filed on Oct. 25, 2006.

(51) Int. Cl.
*B05D 7/00* (2006.01)

(52) U.S. Cl. ..... 427/402; 427/404; 427/405; 427/419.1; 427/419.8

(58) Field of Classification Search ..... 252/500; 427/402, 404, 405, 419.1, 419.8
See application file for complete search history.

(56) References Cited

U.S. PATENT DOCUMENTS

2006/0008588 A1* 1/2006 Chilla et al. ..... 427/402
* cited by examiner

*Primary Examiner* — Eisa Elhilo

(57) ABSTRACT

A process for the production of multi-layer coatings in A' color shades, comprising the successive steps:
1) applying a base coat layer in a total process film thickness in the range from 10 to 35 μm to a substrate provided with an EDC primer,
2) applying a clear coat layer onto the base coat layer,
3) jointly curing the base coat and clear coat layers,
wherein the base coat layer is applied in a first layer of a modified water-borne base coat modAB prepared by mixing an unmodified, water-borne base coat A with an unmodified water-borne base coat B and with a pigment-free admixture component and in a second layer of the unmodified water-borne base coat A.

6 Claims, No Drawings

PROCESS FOR THE PRODUCTION OF MULTI-LAYER COATINGS

FIELD OF THE INVENTION

The invention relates to a process for the production of multi-layer coatings.

BACKGROUND OF THE INVENTION

Automotive coatings generally comprise a separately baked electrodeposition coating (EDC) primer, a separately baked primer surfacer layer (filler layer) applied thereto and a top coat applied thereto comprising a wet-on-wet applied color- and/or special effect-imparting base coat layer and a protective, gloss-imparting clear coat layer. The total primer surfacer plus base coat layer thickness is generally 30 to 60 μm, in case of metallic color shades (color tones) more in the lower range of 30 to 45 μm.

Processes are known from WO 97/47401 and U.S. Pat. No. 5,976,343 for the production of decorative multi-layer coatings, which processes allow for the elimination of the application and separate baking of a primer surface layer which, of course, reduces coating material consumption and total layer thickness. In these processes, a multi-layer coating structure comprising a first, modified water-borne base coat, a second, unmodified water-borne base coat and a clear coat is applied by a wet-on-wet-on-wet process comprising the joint curing of these three coating layers that are applied to a baked EDC primer. In practice, these processes use two base coat layers that allow for markedly lower total layer thickness by approximately 15 to 25 μm, than that of a conventional primer surfacer and base coat. The modified water-borne base coat is produced in these processes from an unmodified water-borne base coat by mixing with an admixture component. The modified water-borne base coat replaces a conventional primer surfacer. WO 97/47401 recommends as an admixture component, the addition of polyisocyanate crosslinking agent, while U.S. Pat. No. 5,976,343 describes the addition of polyurethane resin.

A weakness of the processes known from WO 97/47401 and U.S. Pat. No. 5,976,343 is that it is not straightforwardly possible to produce multi-layer coatings in certain color shades ("problematic color shades"). The reason is UV light (UV radiation), as a constituent of natural daylight, passes through the coating layers applied to the EDC primer to the surface of the EDC primer to a noticeable extent in the absence of a primer surfacer layer and causes degradation of the EDC primer.

The color shades which are problematic with regard to the production of primer surfacer-free multi-layer coatings are those which, while (like unproblematic color shades) providing a coating which appears to an observer to be opaque, permit an inadmissibly large amount of UV light to penetrate through the multi-layer structure of clear coat, unmodified water-borne base coat and modified water-borne base coat to the surface of the EDC primer and cause long term damage to the EDC layer. Such problematic color shades are to be found both among solid color shades (plain color shades, single-tone color shades; generally independent of observation angle; pigment content without special effect pigments) and special effect color shades. Examples may, in particular, be found among water-borne base coats with dark blue solid color shades based on phthalocyanine pigments and among water-borne base coats with specific special effect color shades, for example, dark blue metallic color shades or light metallic color shades, such as, in particular, silver color shades and among water-borne base coats with specific special effect color shades containing elevated proportions of mica pigments in the pigment content. In the case of the problematic color shades, the UV light may penetrate through the multi-layer coating structure, for example, to an extent exceeding the specified UV transmission level and reaches the EDC layer. Car manufacturers' specifications state, for example, that UV transmission through the base coat layer in the area of the complete outer skin of the vehicle body should amount to less than 0.1% in the wavelength range of from 280 to 380 nm, to less than 0.5% in the wavelength range of from 380 to 400 nm and to less than 1% in the wavelength range of from 400 to 450 nm. The possible undesired long-term consequences of an inadmissible level of UV light penetration to the EDC layer are chalking of the EDC layer and delamination of the multi-layer coating over the service life of the coated substrates.

Alternatively, the modified and/or the unmodified water-borne base coat could be applied in an overall higher layer thickness sufficient to prevent to an adequate degree the access of UV light to the EDC primer. However, this would be a backward technological step in the direction of high total film thickness.

The use of UV absorbers in clear coats or base coats is known, for example, from U.S. Pat. No. 5,574,166 and WO 94/18278, and is a solution to the problem of delamination. However, UV absorbers cannot be used to a very great extent in the base coat layers and/or the clear coat layer because of the migration tendency of the UV absorbers and because of the gradual degradation of the UV absorbers, as well as for cost reasons.

Other solutions, which approach the delamination problem from the EDC side are known from EP 0 576 943, U.S. Pat. No. 6,368,719, U.S. 2003/0054193 A1 and U.S. 2003/0098238 A1. These disclose the use of EDC coating compositions which are resistant to the action of UV light due to specially selected binders or due to the addition of suitable additives. This inevitably restricts the EDC composition, such that concessions may have to be made in relation to other technological properties, such as, for example, corrosion protection.

SUMMARY OF THE INVENTION

The advantages of the processes according to WO 97/47401 and U.S. Pat. No. 5,976,343 (dispensing with application of primer surfacer and providing low total film thickness) may be retained while nevertheless sufficiently suppressing access of UV light, which is destructive over the long term, to the EDC primer if the unmodified water-borne base coat is modified with a pigment-free admixture component and an unmodified water-borne base coat having a specific pigment content. UV transmission through the base coat layer formed of modified water-borne base coat and unmodified water-borne base coat may then be adjusted to less than 0.1% in the wavelength range of from 280 to 380 nm, to less than 0.5% in the wavelength range of from 380 to 400 nm and to less than 1% in the wavelength range of from 400 to 450 nm, whereby, for example, corresponding car manufacturers' specifications may be fulfilled.

The invention is directed to a process for the production of multi-layer coatings in A' color shades, comprising the successive steps:

1) applying a base coat layer in a total process film thickness in the range from 10 to 35 μm to a substrate provided with an EDC primer,
2) applying a clear coat layer onto the base coat layer, 3) jointly curing the base coat and clear coat layers, wherein the base coat layer is applied in a first layer and in a second layer; the first layer comprises a modified water-borne base coat modAB produced by mixing an unmodified water-borne base coat AB with a pigment-free admixture component and the second layer comprises an unmodified water-borne base coat A having a color shade A', wherein the unmodified water-borne base coat AB is a mixture of 100 pbv (parts by volume) of the unmodified water-borne base coat A and 1 to 150 pbv, preferably 1 to 50 pbv of an unmodified water-borne base coat B having a color shade B', wherein the pigment-free admixture component is selected from the group consisting of a pigment-free admixture component I and a pigment-free admixture component II, wherein admixture component I comprises one or more binders C, and being mixed into the unmodified water-borne base coat AB in a ratio by weight of 0.1 to 1 parts of binder(s) C:1 part of resin solids of the unmodified water-borne base coat AB; and wherein admixture component II comprises one or more polyisocyanates, and being mixed into the unmodified water-borne base coat AB in a ratio by weight of 0.2 to 1 parts of polyisocyanate:1 part of resin solids of the unmodified water-borne base coat AB, and wherein the pigment content of the unmodified water-borne base coat B comprises at least one pigment which effectively reduces UV transmission and wherein the pigment content is made such that UV light can penetrate through the base coat layer formed from modified water-borne base coat modAB and unmodified water-borne base coat A only in accordance with a UV transmission of less than 0.1% in the wavelength range of from 280 to 380 nm, of less than 0.5% in the wavelength range of from 380 to 400 nm and of less than 1% in the wavelength range of from 400 to 450 nm.

DETAILED DESCRIPTION OF THE EMBODIMENTS

The film thicknesses indicated in the description and in the claims for coating layers refer in each case to dry film thicknesses. In the description and the claims the term "process film thickness" is used. The meaning of this term will be explained hereinbelow.

The term "pigment content" used in the description and in the claims means the sum of all the pigments contained in a coating composition without fillers (extenders). The term "pigments" is used here as in DIN 55944 and covers, in addition to special effect pigments, inorganic white, colored and black pigments and organic colored and black pigments. At the same time, therefore, DIN 55944 distinguishes between pigments and fillers.

The description and the claims mention "pigments which effectively reduce UV transmission". Obviously, all pigments ultimately reduce UV transmission, but to a differing extent depending on the pigment, such that a distinction can be drawn between two groups of pigments, those exhibiting stronger UV absorption or UV reflection and those exhibiting weaker UV absorption or UV reflection. Accordingly, the phrase "pigment which effectively reduces UV transmission" means a pigment, which is sufficiently suited to reducing UV transmission for the purposes of the process according to the invention.

The description and the claims mention "one or more binders C". This serves to distinguish between the binder(s) of the unmodified water-borne base coats A, B and AB and the binder(s) C of the pigment-free admixture component I.

In the process according to the invention conventional substrates provided with an EDC primer, preferably a cathodic electrodeposition (CED) coating, are coated. In particular, the substrates are automotive bodies or automotive body parts. The production of substrates provided with an EDC primer is known to the person skilled in the art. There are no restrictions with regard to the selection of the EDC primer; in particular, EDC primers are also suitable which would be damaged by long-term exposure to UV light.

In step 1) of the process according to the invention, the substrates having an EDC primer are provided, with a base coat layer in a total process film thickness in the range from 10 to 35 μm. This base coat layer is applied in two layers, i.e., a first layer having an individual process film thickness in the range from, for example, 5 to 25 μm of a modified water-borne base coat modAB produced by mixing an unmodified water-borne base coat AB with a pigment-free admixture component is applied and a subsequent second layer in an individual process film thickness in the range from, for example, 3 to 20 μm of the unmodified water-borne base coat A then is applied. The total process film thickness of the base coat layer is dependent inter alia on color shade. Car manufacturers' requirements for base coat film thickness are expressed in the so-called process film thickness (average film thickness which is desired over the entire body in the automotive original coating process), which depends on the individual color shade, on technological properties to be achieved (e.g., stone chip resistance) and on an economic application of the relevant water-borne base coat, i.e., in as thin a film as possible. The total base coat process film thickness lies in the range from 10 to 35 μm and is the sum of, for example, 5 to 25 μm of the modified water-borne base coat modAB plus, for example, 3 to 20 μm of the unmodified water-borne base coat A. Such film thicknesses for base coats meet the requirements for coating the relevant substrates, for example, automotive bodies. In particular, this means that a specific value within this range from 10 to 35 μm represents the specific total process film thickness for a particular base coat, for example, a base coat of a particular color shade. Said specific total process film thickness is here composed of the sum of the specific individual process film thickness, lying within the range of, for example, 5 to 25 μm, of the corresponding modified water-borne base coat modAB and the specific individual process film thickness, lying within the range of, for example, 3 to 20 μm of the corresponding unmodified water-borne base coat A.

In the present invention a distinction is drawn between (i) unmodified water-borne base coats A, B and AB and (ii) modified water-borne base coats modAB. Whereas the unmodified water-borne base coats A are those with problematic color shades with regard to UV transmission, this is not true for the unmodified water-borne base coats B.

The color shades of a coating applied from an unmodified water-borne base coat A in opaque film thickness and of a corresponding multi-layer coating prepared according to the process of the invention are so close to each other that an observer virtually cannot perceive a difference between the color shades. Therefore, in the present description and the claims, the color shades of the unmodified water-borne base coats A and of coatings applied thereof in opaque film thickness are called color shades A'. The color shades of the corresponding multi-layer coatings prepared according to the process of the invention are also called color shades A'. Accordingly, the color shades of the unmodified water-borne base coats B and of coatings applied thereof in opaque film thickness are called color shades B'.

The unmodified water-borne base coats AB may be produced by mixing 100 pbv of unmodified water-borne base coat A with 1 to 150 pbv, preferably 1 to 50 pbv of an unmodified water-borne base coat B. The unmodified water-borne base coat B to be mixed with the unmodified water-borne base coat A may be one individual water-borne base coat B or a mixture of two or more different unmodified water-borne base coats B; preferably it is one individual water-borne base, coat B.

The modified water-borne base coats modAB may be produced by (i) mixing the unmodified water-borne base coats AB with the pigment-free admixture component I in a ratio by weight of 0.1 to 1 parts of binder(s) C:1 part of resin solids of the unmodified water-borne base coat AB or by (ii) mixing the unmodified water-borne base coats AB with the pigment-free admixture component II in a ratio by weight of 0.2 to 1 parts of polyisocyanate:1 part of resin solids of the unmodified water-borne base coat AB.

In principle there is no restriction regarding the mixing sequence provided the stated volume and weight ratios are met. To avoid misunderstandings, the phrase "a modified water-borne base coat modAB produced by mixing an unmodified water-borne base coat AB with a pigment-free admixture component" shall not be understood to rule out another mixing sequence. In other words, it is possible to mix the unmodified water-borne base coats A and B first and then to mix the resulting unmodified water-borne base coat AB with the pigment-free admixture component I or II; especially in case of an admixture component II this is the preferred mixing sequence. However, it is also possible to mix the unmodified water-borne base coat A or B with the pigment-free admixture component I or II first and then to mix the resulting mixture with the unmodified water-borne base coat B or A; this mixing sequence corresponds to an insitu production of an unmodified water-borne base coat AB. It is also possible to mix the unmodified water-borne base coats A and B and the pigment-free admixture component I or II simultaneously.

The unmodified water-borne base coats A and B must be chemically compatible with each other, i.e. miscible with each other without problems, for example, without formation of coagulate or precipitate. Whereas this is generally guaranteed in case unmodified water-borne base coats A and B are supplied by the same paint manufacturer, it is necessary to ensure such compatibility in case there is more than one supplier for the unmodified water-borne base coats A and B. The unmodified water-borne base coats A and B to be mixed should not differ from each other too much in viscosity to allow for easy mixing. For example, the difference in viscosity should not exceed 50 mPa·s at a shear rate of 1000 $s^{-1}$ at 20° C.

The unmodified water-borne base coats A, B and AB are aqueous coating compositions having a ratio by weight of pigment content to resin solids content of, for example, 0.05:1 to 1:1. In addition to water, pigment(s), a resin solids content, which comprises binder(s), optionally, paste resin(s) and optionally, cross-linking agent(s), optionally, filler(s) and optionally, organic solvent(s), the unmodified water-borne base coats A, B and AB contain in general also conventional additive(s).

The unmodified water-borne base coats A, B and AB contain ionically and/or non-ionically stabilized binder systems. In case of ionic stabilization anionic stabilization is preferred. Anionic stabilization is preferably achieved by at least partially neutralized carboxyl groups in the binder, while non-ionic stabilization is preferably achieved by lateral or terminal polyethylene oxide units in the binder. The unmodified water-borne base coats A, B and AB may be physically drying or crosslinkable by formation of covalent bonds. The crosslinkable unmodified water-borne base coats A, B and AB forming covalent bonds may be self- or externally crosslinkable systems.

The unmodified water-borne base coats A, B and AB contain one or more conventional film-forming binders. They may optionally also contain crosslinking agents if the binders are not self-crosslinkable or physically drying. Examples of film-forming binders, which may be used, are conventional polyester, polyurethane, (meth)acrylic copolymer and/or hybrid resins derived from these classes of resin. Selection of the optionally contained crosslinking agents depends, in a manner familiar to the person skilled in the art, on the functionality of the binders, i.e., the crosslinking agents are selected in such a way that they exhibit a reactive functionality complementary to the functionality of the binders. Examples of such complementary functionalities between binder and crosslinking agent are: carboxyl/epoxy, hydroxyl/methylol ether and/or methylol (methylol ether and/or methylol preferably, as crosslinkable groups of aminoplast resins, in particular, melamine resins).

The term "polyurethane resin" as used in the present invention does not rule out that the polyurethane resin in question may also contain groups other than urethane groups in the polymer backbone, such as, in particular, ester groups and/or urea groups. Instead, the term "polyurethane resin" of course, also in particular, includes polyurethane resins which contain polyester polyol building blocks and/or urea groups, wherein the latter may, for example, be formed by the reaction of isocyanate groups with water and/or polyamine.

If the process according to the invention is performed with a pigment-free admixture component II, it is preferred to work with unmodified water-borne base coats AB which comprise a resin solids content comprising one or more hydroxyl-functional binders. Here, the hydroxyl value of the resin solids content of the unmodified water-borne base coat AB is, for example, in the range of from 10 to 150 mg KOH/g, the NCO/OH molar ratio in the modified water-borne base coat modAB is, for example, 0.5:1 to 25:1. However, in the case of unmodified water-borne base coats AB with a low-hydroxyl or hydroxyl-free resin solids content, higher NCO/OH molar ratios may also arise in the corresponding modified water-borne base coats modAB. For example, the NCO/OH molar ratios may even extend towards infinity. In such cases, the polyisocyanate in the modified water-borne base coat modAB is consumed by reaction with other constituents, which are reactive in relation to isocyanate groups, for example, with water, hydroxyl-functional solvents and/or with functional groups of binders which are reactive with isocyanate and are different from hydroxyl groups.

The unmodified water-borne base coats A, B and AB contain conventional pigments, for example, special effect pigments and/or pigments selected from among white, colored and black pigments.

Examples of special effect pigments are conventional pigments which impart to a coating color flop and/or lightness flop dependent on the observation angle, such as, non-leafing metal pigments, for example, of aluminum, copper or other metals, interference pigments, such as, for example, metal oxide-coated metal pigments, for example, iron oxide-coated aluminum, coated mica, such as, for example, titanium dioxide-coated mica, graphite effect-imparting pigments, iron oxide in flake form, liquid crystal pigments, coated aluminum oxide pigments, coated silicon dioxide pigments.

Examples of white, colored and black pigments are the conventional inorganic or organic pigments known to the person skilled in the art, such as, for example, titanium dioxide, iron oxide pigments, carbon black, azo pigments, phthalocyanine pigments, quinacridone pigments, pyrrolopyrrole pigments, perylene pigments.

The unmodified water-borne base coats A, B and AB may also contain fillers, for example, in proportions of 0 to 30 wt. % relative to the resin solids content. The fillers do not constitute part of the pigment content of the unmodified water-borne base coats A, B and AB. Examples are barium sulfate, kaolin, talcum, silicon dioxide, layered silicates and any mixtures thereof.

The special effect pigments are generally initially introduced in the form of a conventional commercial aqueous or non-aqueous paste, optionally, combined with preferably water-dilutable organic solvents and additives and then mixed with aqueous binder. Pulverulent special-effect pigments may first be processed with preferably water-dilutable organic solvents and additives to yield a paste.

White, colored and black pigments and/or fillers may, for example, be ground in a proportion of the aqueous binder. Grinding may preferably also take place in a special aqueous paste resin. Grinding may be performed in conventional assemblies known to the person skilled in the art. The formulation is then completed with the remaining proportion of the aqueous binder or of the aqueous paste resin.

The unmodified water-borne base coats A, B and AB may contain conventional additives in conventional quantities, for example, of 0.1 to 5 wt. %, relative to the solids content thereof. Examples are antifoaming agents, wetting agents, adhesion promoters, catalysts, levelling agents, anticratering agents, thickeners and light stabilizers, for example, UV absorbers and/or HALS-based compounds (HALS, hindered amine light stabilizers). If the unmodified water-borne base coats contain light stabilizers, these are by no means solely responsible for UV light being able to penetrate through the base coat layer formed from modified water-borne base coat modAB and unmodified water-borne base coat A only in accordance with a UV transmission of less than 0.1% in the wavelength range of from 280 to 380 nm, of less than 0.5% in the wavelength range of from 380 to 400 nm and of less than 1% in the wavelength range of from 400 to 450 nm. This effect is instead, in particular with regard to the durability thereof, achieved by making use of an unmodified water-borne base coat B when producing the unmodified water-borne base coat AB or modified water-borne base coat modAB respectively.

The water content of the unmodified water-borne base coats A, B and AB is, for example, 60 to 90 wt. %.

The unmodified water-borne base coats A, B and AB may contain conventional organic solvents, for example, in a proportion of preferably less than 20 wt. %, particularly preferably, less than 15 wt. %. Examples of such solvents are mono- or polyhydric alcohols, for example, propanol, butanol, hexanol; glycol ethers or esters, for example, diethylene glycol di-C1-C6-alkyl ether, dipropylene glycol di-C1-C6-alkyl ether, ethoxypropanol, ethylene glycol monobutyl ether; glycols, for example, ethylene glycol and/or propylene glycol, and the di- or trimers thereof, N-alkylpyrrolidone, such as for example, N-methylpyrrolidone; ketones, such as, methyl ethyl ketone, acetone, cyclohexanone; aromatic or aliphatic hydrocarbons, for example, toluene, xylene or linear or branched aliphatic C6-C12 hydrocarbons.

The unmodified water-borne base coats A, B and AB have solids contents of, for example, 10 to 40 wt. %, preferably, of 15 to 30 wt. %.

As already mentioned, the unmodified water-borne base coats A have problematic color shades with regard to UV transmission, i.e., they comprise water-borne base coats which are distinguished in that UV light corresponding to a UV transmission of more than 0.1% in the wavelength range of from 280 to 380 nm and/or of more than 0.5% in the wavelength range of from 380 to 400 nm and/or of more than 1% in the wavelength range of from 400 to 450 nm may penetrate through a base coat layer applied in the process film thickness and (i) consisting of a relevant unmodified water-borne base coat A mixed with the pigment-free admixture component I in a ratio by weight of 0.1 to 1 parts of binder(s) C:1 part of resin solids of the unmodified water-borne base coat A and the corresponding unmodified water-borne base coat A or (ii) consisting of a relevant unmodified water-borne base coat A mixed with the pigment-free admixture component II in a ratio by weight of 0.2 to 1 parts of polyisocyanate:1 part of resin solids of the unmodified water-borne base coat A and the corresponding unmodified water-borne base coat A. In other words, the unmodified water-borne base coats A with problematic color shades have such low levels of pigmentation (ratio by weight of pigment content to resin solids content) and/or such pigment contents that, by virtue of the type and proportion of the constituent pigments, UV light corresponding to a UV transmission of more than 0.1% in the wavelength range of from 280 to 380 nm and/or of more than 0.5% in the wavelength range of from 380 to 400 nm and/or of more than 1% in the wavelength range of from 400 to 450 nm may penetrate through a base coat layer applied in the process film thickness and (i) consisting of a relevant unmodified water-borne base coat A mixed with the pigment-free admixture component I in a ratio by weight of 0.1 to 1 parts of binder(s) C:1 part of resin solids of the unmodified water-borne base coat A and the corresponding unmodified water-borne base coat A or (ii) consisting of a relevant unmodified water-borne base coat A mixed with the pigment-free admixture component II in a ratio by weight of 0.2 to 1 parts of polyisocyanate:1 part of resin solids of the unmodified water-borne base coat A and the corresponding unmodified water-borne base coat A. In still other and more general words, the unmodified water-borne base coats A with problematic color shades have excessively low levels of pigmentation and/or pigment contents without or with excessively small proportions of pigments which effectively reduce UV transmission. Such unmodified water-borne base coats A may be found among unmodified water-borne base coats A both with solid color shades and with special effect color shades. Examples may in particular be found among water-borne base coats with dark blue solid color shades based on phthalocyanine pigments and among water-borne base coats with specific special effect color shades, for example, dark blue metallic color shades or light metallic color shades, such as, in particular, silver color shades and among water-borne base coats with specific special effect color shades containing elevated proportions of mica pigments in the pigment content.

UV transmission may be measured by applying a corresponding coating structure of modified water-borne base coat modAB and unmodified water-borne base coat A to a UV light-transmitting support, for example, a silica glass plate, and measuring the UV transmission in the corresponding wavelength range using a corresponding uncoated UV light-transmitting support as reference. It is self-explanatory that in order to correctly determine the difference in UV transmission between a base coat structure produced according to the invention and a corresponding base coat structure produced (i) making use of a pigment-free admixture component I and without making use of an unmodified water-borne base coat B or (ii) making use of a pigment-free admixture component II and without making use of an unmodified water-borne base coat B, it is necessary to work under similar conditions. With regard to the invention this means, in particular, to choose in both cases the same ratio by weight between (i) binder(s) C and resin solids of unmodified water-borne base coat A within the stated range of 0.1 to 1 parts:1 part or (ii) polyisocyanate and resin solids of unmodified water-borne base coat A within the stated range of 0.2 to 1 parts:1 part.

The unmodified water-borne base coats B have unproblematic color shades with regard to UV transmission, i.e., they comprise water-borne base coats which are distinguished in that UV light corresponding to a UV transmission of less than 0.1% in the wavelength range of from 280 to 380 nm, of less than 0.5% in the wavelength range of from 380 to 400 nm and of less than 1% in the wavelength range of from 400 to 450 nm may penetrate through a base coat layer applied in the process film thickness and (i) consisting of a relevant unmodified water-borne base coat B mixed with the pigment-free admixture component I in a ratio by weight of 0.1 to 1 parts of binder(s) C:1 part of resin solids of the unmodified water-borne base coat B and the corresponding unmodified water-borne base coat B or (ii) consisting of a relevant unmodified water-borne base coat B mixed with the pigment-free admixture component II in a ratio by weight of 0.2 to 1 parts of polyisocyanate:1 part of resin solids of the unmodified water-borne base coat B and the corresponding unmodified water-borne base coat B. Such unmodified water-borne base coats B may be found among unmodified water-borne base coats B both with solid color shades and with special effect color shades. Examples may in particular be found among unmodified water-borne base coats B with certain color shades, in particular, for example, white color shades, black color shades, green color shades, red color shades based on iron oxide pigments and yellow color shades based on bismuth vanadate pigments. Unmodified water-borne base coats B with a solid color shade are preferred, in particular in case they are to be mixed with an unmodified water-borne base coat A with a solid color shade.

The pigment content of the unmodified water-borne base coat B comprises at least one pigment, which effectively reduces UV transmission. The pigment content of the unmodified water-borne base coat B is made such that, with a given (particular) unmodified water-borne base coat A, a given specific total process film thickness (and in each case also specific individual process film thicknesses for the modified water-borne base coat modAB and for the unmodified water-borne base coat A), a given mixing ratio of unmodified water-borne base coat A and B in the corresponding aforementioned range, a given mixing ratio of pigment-free admixture component I or II and unmodified water-borne base coat AB in the corresponding aforementioned range, UV light can penetrate through the base coat layer formed from modified water-borne base coat modAB and unmodified water-borne base coat A only in accordance with a UV transmission of less than 0.1% in the wavelength range of from 280 to 380 nm, of less than 0.5% in the wavelength range of from 380 to 400 nm and of less than 1% in the wavelength range of from 400 to 450 nm. In particular, the pigment content of the unmodified water-borne base coat B is selected by type (qualitative and quantitative composition of the pigments forming the pigment content) and quantity accordingly.

Apart from the at least one pigment which effectively reduces UV transmission, the pigment content of the unmodified water-borne base coat B may also comprise other pigments.

Examples of pigments which effectively reduce UV transmission and may be used alone or in combination in the pigment content of the unmodified water-borne base coat B are in particular carbon black, titanium dioxide, iron oxide pigments, bismuth vanadate pigments and aluminum flake pigments, the latter in particular with average particle sizes, for example, in the range from 1 to 20 μm at flake thicknesses of, for example, 10 nm to 1 μm.

Examples of pigment contents of a suitable composition with regard to the desired reduction in UV transmission and for the purposes of the process according to the invention are pigment contents of the unmodified water-borne base coats B consisting of 0 to 100 wt. % of carbon black, 0 to 100 wt. % of titanium dioxide, 0 to 100 wt. % of one or more aluminum flake pigments, for example, one or more of the aluminum flake pigments stated in the preceding paragraph, 0 to 100 wt. % of one or more iron oxide pigments and 0 to 90 wt. % of one or more other pigments, wherein the weight percentages add up to 100 wt. %.

In the first embodiment of the process according to the invention the modified water-borne base coat modAB is produced from the unmodified water-borne base coat AB by mixing with the pigment-free admixture component I in a ratio by weight of 0.1 to 1 parts, preferably of 0.1 to 0.5 parts of binder(s) C:1 part of resin solids of the unmodified water-borne base coat AB.

The addition of the pigment-free admixture component I to the unmodified water-borne base coat AB imparts to the resultant modified water-borne base coat modAB technological properties, such as, for example, stone chip resistance, which are important to the finished multi-layer coating.

The pigment-free admixture component I containing one or more binder(s) C is a composition with a solids content of, for example, 20 to 95 wt. %, in general, of 30 to 60 wt. %. The volatile content is formed, in addition to possible volatile additives, by water and/or organic solvent. The solids content itself consists of the resin solids content plus possible non-volatile additives.

The resin solids content of the pigment-free admixture component I comprises one or more binders C and, optionally, one or more crosslinking agents, for example, blocked polyisocyanates, aminoplast resins, such as, for example, melamine resins. In general, the resin solids content consists to an extent of, for example, 70 to 100 wt. % of the at least one binder C plus 0 to 30 wt. % of at least one crosslinking agent, wherein the weight percentages add up to 100 wt. %.

The binder(s) C of the pigment-free admixture component I may comprise the same binders as in the unmodified water-borne base coats A, B or AB and/or binders which differ therefrom.

The binder(s) C are conventional water-dilutable, preferably anionically stabilized binders, for example, corresponding polyester, polyurethane, (meth)acrylic copolymer and/or hybrid resins derived from these classes of resin. Polyester and in particular polyurethane resins are preferred.

Apart from the groups which ensure water dilutability, such as, in particular carboxyl groups, the binders C may comprise functional groups which may be involved in a crosslinking reaction which optionally proceeds during the subsequent thermal curing of the modified water-borne base coat modAB; such crosslinking reactions are in particular addition and/or condensation reactions. The binders C may also be self-crosslinkable. Examples of binders' C functional groups are hydroxyl groups, blocked isocyanate groups and epoxy groups.

The pigment-free admixture component I generally comprises an aqueous composition; it then contains, for example, 20 to 70 wt. % water.

Irrespective of whether it is an aqueous or non-aqueous composition, the pigment-free admixture component I may contain one or more organic solvents, for example, in a total quantity of 5 to 70 wt. %. Examples of such solvents are mono- or polyhydric alcohols, for example, propanol, butanol, hexanol; glycol ethers or esters, for example, diethylene glycol C1-C6 dialkyl ethers, dipropylene glycol C1-C6 dialkyl ethers, ethoxypropanol, butylglycol; glycols, for example, ethylene glycol and/or propylene glycol, and the di- or trimers thereof; N-alkylpyrrolidones, for example N-methylpyrrolidone and ketones, for example, methyl ethyl ketone, acetone, cyclohexanone; aromatic or aliphatic hydrocarbons, for example, toluene, xylene, or linear or branched aliphatic C6-C12 hydrocarbons. The solvents are preferably water-dilutable.

In addition to the at least one binder C and the in each case optional constituents water and organic solvent, the pigment-free admixture component I may contain additives in proportions of in each case, for example, 0.1 to 4 wt. %, corresponding to a total quantity of in general no more than 6 wt. %. Examples of additives are defoamers, anticratering agents, wetting agents, neutralizing agents and rheology control agents. The pigment-free admixture component I may, although not preferably, contain light stabilizers, for example, UV absorbers and/or HALS-based compounds. If the pigment-free admixture component I contains light stabilizers, these are by no means solely responsible for UV light being able to penetrate through the base coat layer formed from modified water-borne base coat modAB and unmodified water-borne base coat A only in accordance with a UV transmission of less than 0.1% in the wavelength range of from 280 to 380 nm, of less than 0.5% in the wavelength range of from 380 to 400 nm and of less than 1% in the wavelength range of from 400 to 450 nm. This effect is instead, in particular with regard to the durability thereof, achieved by making use of an unmodified water-borne base coat B when producing the unmodified water-borne base coat AB or modified water-borne base coat modAB respectively.

In the second embodiment of the process according to the invention the modified water-borne base coat modAB is produced from the unmodified water-borne base coat AB by mixing with the pigment-free admixture component II in a ratio by weight of 0.2 to 1 parts, preferably of 0.2 to 0.8 parts of polyisocyanate:1 part of resin solids of the unmodified water-borne base coat AB.

The addition of the pigment-free admixture component II to the unmodified water-borne base coat AB imparts to the resultant modified water-borne base coat technological properties, such as, for example, stone chip resistance, which are important to the finished multi-layer coating:

The pigment-free admixture component II containing one or more polyisocyanates is a composition with a solids content of, for example, 20 to 95 wt. %, in general, of 40 to 80 wt. %. The volatile content is formed, in addition to possible volatile additives, by water and/or organic solvent. The solids content itself consists of the resin solids content and, optionally, plus nonvolatile additives.

The resin solids content of the pigment-free admixture component II comprises one or more polyisocyanates. In general, the resin solids content consists to an extent of 100 wt. % of polyisocyanate(s).

The term "polyisocyanate(s)" used in connection with the pigment-free admixture component II is not restricted to the meaning free polyisocyanate or free polyisocyanates, but instead also includes blocked polyisocyanate or blocked polyisocyanates. The polyisocyanate(s) contained in the pigment-free admixture component II accordingly comprise one or more free polyisocyanates, one or more blocked polyisocyanates or a combination of one or more free polyisocyanates and one or more blocked polyisocyanates. Free polyisocyanates are preferred.

The polyisocyanates comprise di- and/or poly-isocyanates with aliphatically, cycloaliphatically, araliphatically and/or less preferably aromatically attached isocyanate groups.

The polyisocyanates are liquid at room temperature or are present as an organic solution; the polyisocyanates here exhibit at 23° C. a viscosity of in general 0.5 to 2000 mPa·s. The isocyanate content of the polyisocyanates present in the form of free or latent (blocked, thermally re-dissociable) isocyanate groups is in general in a range from 2 to 25 wt. %, preferably, from 5 to 25 wt. % (calculated as NCO).

Examples of diisocyanates are hexamethylene diisocyanate, tetramethylxylylene diisocyanate, isophorone diisocyanate, dicyclohexylmethane diisocyanate, and cyclohexane diisocyanate.

Examples of polyisocyanates are those which contain heteroatoms in the residue linking the isocyanate groups. Examples of these are polyisocyanates which contain carbodiimide groups, allophanate groups, isocyanurate groups, uretidione groups, urethane groups, acylated urea groups or biuret groups. The polyisocyanates preferably have an isocyanate functionality higher than 2, such as, for example, polyisocyanates of the uretidione or isocyanurate type produced by di- or trimerization of the above-mentioned diisocyanates. Further examples are polyisocyanates produced by reaction of the above-mentioned diisocyanates with water and containing biuret groups or polyisocyanates produced by reaction with polyols and containing urethane groups.

Of particular suitability are, for example, "coating polyisocyanates" based on hexamethylene diisocyanate, isophorone diisocyanate or dicyclohexylmethane diisocyanate. "Coating polyisocyanates" based on these diisocyanates means the per se known biuret, urethane, uretidione and/or isocyanurate group-containing derivatives of these diisocyanates.

As already mentioned above, the polyisocyanates may be used in blocked form, though this is not preferred. They may be blocked with conventional blocking agents that can be de-blocked under the action of heat, for example, with alcohols, oximes, amines and/or CH-acidic compounds.

The blocked or preferably free polyisocyanates may be used in the pigment-free admixture component II as such or as a preparation containing water and/or organic solvent, wherein in the case of free polyisocyanate no water and no organic solvent with active hydrogen is used. It may be desirable, for example, for the polyisocyanates to be pre-diluted with a water-miscible organic solvent or solvent mixture. In this case, it is preferable to use solvents, which are inert relative to isocyanate groups, especially where the preferred free polyisocyanates are used. Examples are solvents which do not contain any active hydrogen, for example, ethers, such as, for example, diethylene glycol diethyl ether, dipropylene glycol dimethyl ether; glycol ether esters, such as, ethylene glycol monobutyl ether acetate, diethylene glycol monobutyl ether acetate, methoxypropyl acetate; and N-methylpyrrolidone.

Also suitable are hydrophilic polyisocyanates, which may be stabilized in the aqueous phase by a sufficient number of ionic groups and/or by terminal or lateral polyether chains. Hydrophilic polyisocyanates are sold as commercial products, for example, by Bayer under the name Bayhydur®.

When producing a preferred pigment-free admixture component II containing free polyisocyanate, it is expedient not only to avoid the deliberate addition of water, but also to perform processing with the most extensive possible, preferably complete, exclusion of water and in general also with the most extensive possible, preferably complete, exclusion of other substances reactive towards isocyanate groups, such as, for example, alcohols. Apart from selecting appropriate raw materials, it is additionally possible to work with water-binding auxiliaries. For example, water scavengers, such as, orthoesters may be added during production and storage of the pigment-free admixture component II containing free polyisocyanate.

The pigment-free admixture component II may, if it contains no free polyisocyanate, contain, for example, 20 to 70 wt. % water.

The pigment-free admixture component II may contain one or more organic solvents, for example, in a total quantity of 5 to 70 wt. %. The solvents are preferably water-dilutable. In the case of the preferred admixture components II containing free polyisocyanate, the solvents are those which are inert towards isocyanate groups. Examples of suitable solvents are ethers, such as, for example, diethylene glycol diethyl ether, dipropylene glycol dimethyl ether; glycol ether esters, such as, ethylene glycol monobutyl ether acetate, diethylene glycol monobutyl ether acetate, methoxypropyl acetate; and N-methylpyrrolidone.

In addition to the at least one polyisocyanate and in each case optional constituents water and organic solvent, the pigment-free admixture component II may contain additives in proportions of in each case, for example, 0.1 to 2 wt. %, corresponding a total quantity of in general no more than 5 wt. %. Examples of additives are the same as those already mentioned for the pigment-free admixture component I. If the pigment-free admixture component II contains light stabilizers, these are by no means solely responsible for UV light being able to penetrate through the base coat layer formed from modified water-borne base coat modAB and unmodified water-borne base coat A only in accordance with a UV transmission of less than 0.1% in the wavelength range of from 280 to 380 nm, of less than 0.5% in the wavelength range of from 380 to 400 nm and of less than 1% in the wavelength range of from 400 to 450 nm. This effect is instead, in particular with regard to the durability thereof, achieved by making use of an unmodified water-borne base coat B when producing the unmodified water-borne base coat AB or modified water-borne base coat modAB respectively.

As already mentioned, in the process according to the invention, the substrates are provided with multi-layer coatings in A' color shades. Typically, the multi-layer coating process according to the invention is performed in an industrial coating facility, i.e. within a mass-production coating line. Generally, there are not only substrates to be provided with multi-layer coatings in A' color shades but also substrates to be provided with corresponding multi-layer coatings in B' color shades. Coating of the latter substrates is performed making use of unmodified water-borne base coats B and, in that case the unmodified water-borne base coats A and the unmodified water-borne base coats B together represent the color shade program selected for the substrates to be multi-layer coated. It is advantageous that the unmodified water-borne base coats B to be mixed with the unmodified water-borne base coats A can then be taken from the group of unmodified water-borne base coats B which represent the B' color shade program. In general the B' color shade program comprises two or more differently colored unmodified water-borne base coats B. This allows for the selection of an appropriate unmodified water-borne base coat B (one individual water-borne base coat B or a mixture of two or more different unmodified water-borne base coats B). In particular such selection may happen dependent on the color shade of the relevant unmodified water-borne base coat A to be mixed with.

As already mentioned, the unmodified water-borne base coats B have unproblematic color shades with regard to UV transmission. Therefore, the process for the production of multi-layer coatings on substrates in B' color shades is different from the process according to the invention. Preferably, the process for the production of multi-layer coatings in B' color shades comprises the successive steps:

1) applying a base coat layer in a total process film thickness in the range from 10 to 35 μm to a substrate provided with an EDC primer,
2) applying a clear coat layer onto the base coat layer,
3) jointly curing the base coat and clear coat layers, wherein the base coat layer is applied in a first layer and, optionally, in a second layer; the first layer comprises a modified water-borne base coat modB produced by mixing an unmodified water-borne base coat B having a color shade B' with a pigment-free admixture component and the optionally applied second layer comprises the unmodified water-borne base coat B, wherein the pigment-free admixture component is selected from the group consisting of a pigment-free admixture component I and a pigment-free admixture component II, wherein admixture component I comprises one or more binders C, and being mixed into the unmodified water-borne base coat B in a ratio by weight of 0.1 to 1 parts of binder(s) C:1 part of resin solids of the unmodified water-borne base coat B; and wherein admixture component II comprises one or more polyisocyanates, and being mixed into the unmodified water-borne base coat B in a ratio by weight of 0.2 to 1 parts of polyisocyanate:1 part of resin solids of the unmodified water-borne base coat B.

In the process according to the invention, the unmodified water-borne base coats A, B and the pigment-free admixture component I or II are mixed preferably on the user's premises, in particular shortly or immediately before application of the resultant modified water-borne base coat modAB. As already mentioned, there are various possibilities for the mixing sequence.

In the case of industrial coating facilities, the unmodified water-borne base coats A and B in each case of a different color shade are each conveyed in their own circulating line. The pigment-free admixture component I or II to be added is preferably used in the form of a single general purpose admixture component, the one pigment-free admixture component I or II likewise being guided in its own circulating line and automatically mixed with the respective unmodified water-borne base coats A and B using mixing technology conventional in industrial coating facilities, for example, a static mixer like a Kenics mixer. When applying water-borne base coat in a color shade program of n A' and m B' color shades, it is therefore not necessary to provide 2n+2m circulating lines (in each case n circulating lines for the different colors of unmodified water-borne base coats A and for the different colors of modified water-borne base coats modAB and in each case m circulating lines for the different colors of unmodified water-borne base coats B and for the different colors of modified water-borne base coats modB), but rather just n circulating lines for the different colors of unmodified water-borne base coats A plus m circulating lines for the different colors of unmodified water-borne base coats B plus one circulating line for the pigment-free admixture component I or II.

In the process according to the invention, the EDC-primed substrates are initially spray-coated with the modified water-borne base coat modAB, preferably by electrostatically-assisted high-speed rotary atomization.

Then, preferably after a brief flash-off phase of, for example, 30 seconds to 5 minutes at an air temperature of 20 to 25° C., the corresponding unmodified water-borne base coat A is spray-applied, preferably by pneumatic spray application.

This is preferably also followed by a brief flash-off phase of, for example, 30 seconds to 10 minutes at an air temperature of 20 to 100° C., after which the clear coat is applied in a dry film thickness of, for example, 20 to 60 μm.

All known clear coats are in principle suitable as the clear coat. Usable clear coats are both solvent-containing one-component (1 pack) or two-component (2 pack) clear coats, water-dilutable 1 pack or 2 pack clear coats, powder clear coats or aqueous powder clear coat slurries.

After an optional flash-off phase, the applied water-borne base coat layer consisting of modified water-borne base coat modAB and unmodified water-borne base coat A and the clear coat layer are jointly cured, for example, by baking, for example, at 80 to 160° C. object temperature.

Using the process according to the invention, EDC-primed substrates may be provided with a primer surfacer-free coating. Any destructive access of UV light though the clear coat and the base coat layer applied from the modified water-borne base coat modAB and the unmodified water-borne base coat A to the EDC primer may here be prevented, despite the base coat layer being applied in a process film thickness of only 10 to 35 μm. Although unmodified water-borne base coats B are mixed into the unmodified water-borne base coats A during production of the unmodified water-borne base coats AB or modified water-borne base coats modAB respectively, it is possible with the process according to the invention to produce multi-layer coatings of the desired color shade. Application and baking of a primer surfacer layer is not necessary, and the technological properties of the multi-layer coatings meet the requirements of car manufacturers.

EXAMPLES

Example 1

Production of a Black Unmodified Water-Borne Base Coat

A black unmodified water-borne base coat of the following composition was produced:

14.1 pbw (parts by weight) of resin solids (7.7 pbw of a polyester polyurethane resin, 3.3 pbw of a polyester acrylate resin, 1.2 pbw of a polyurethane resin, 1.9 pbw of hexamethoxymethylmelamine; hydroxyl value of the resin solids 40.8 mg of KOH/g)

0.6 pbw of carbon black (Raven 5000 Ultra II from Columbian Chemicals)

0.6 pbw of talcum 0.2 pbw of dimethylethanolamine 0.5 pbw of defoamer 0.6 pbw of polyacrylic acid thickener 0.8 pbw of polypropylene glycol 400

13.9 pbw of organic solvents (7.5 pbw of ethylene glycol monobutyl ether, 0.8 pbw of ethylene glycol monohexyl ether, 0.8 pbw of N-methylpyrrolidone, 1.5 pbw of n-butanol, 2.5 pbw of n-propanol, 0.8 pbw of Sheilsol T)

68.7 pbw of water.

Example 2

Production of a Polyisocyanate Admixture Component

A mixture of 30 pbw of N-methylpyrrolidone, 47 pbw of a hydrophilic aliphatic polyisocyanate based on hexamethylene diisocyanate with an NCO value of 17.4 and 23 pbw of a trimerized hexamethylene diisocyanate with an NCO value of 23 was produced.

Example 3

Production of a Blue Unmodified Water-Borne Base Coat a) A blue unmodified, mica pigment-containing water-borne base coat of the following composition was produced:

11.5 pbw of resin solids (5.9 pbw of a polyester polyurethane resin, 2.3 pbw of a polyester acrylate resin, 1.4 pbw of a polyurethane resin, 1.9 pbw of hexamethoxymethylmelamine; hydroxyl value of the resin solids 40.8 mg of KOH/g)

0.21 pbw of mica pigments (0.19 pbw of Iriodin® SW 9225 from Merck; 0.02 pbw of Iriodin® SW 9219 from Merck)

0.07 pbw of aluminum pigments (0.036 pbw of Alpate WXA 7640 from Toyal and 0.034 pbw of Hydrolac WHH 2153 from Eckert)

0.33 pbw of Palomarblue B 4828 from Bayer 1.08 pbw of Monolite Blue 3 RX from Heubach 0.85 pbw of Heliogen® Blue L 6989 F from BASF 0.06 pbw of carbon black (Raven 5000 Ultra II from Columbian Chemicals)

0.8 pbw of Tinuvin® 384-2 from Ciba 0.4 pbw of Tinuvin® 292 from Ciba 0.2 pbw of dimethylethanolamine 0.5 pbw of defoamer 0.6 pbw of polyacrylic acid thickener 0.8 pbw of polypropylene glycol 400

12.4 pbw of organic solvents (6.5 pbw of ethylene glycol monobutyl ether, 0.8 pbw of ethylene glycol monohexyl ether, 0.6 pbw of N-methylpyrrolidone, 1.5 pbw of n-butanol, 2.5 pbw of n-propanol, 0.5 pbw of Shellsol T)

70.2 pbw of water.

b) A modified water-borne base coat was produced by mixing 100 pbw of the unmodified water-borne base coat from a) with 100 pbw of the black water-borne base coat from Example 1 and with 20 pbw of the polyisocyanate admixture component from Example 2.

c) A water-borne coating composition was produced by mixing 100 pbw of the unmodified water-borne base coat from a) with 10 pbw of the polyisocyanate admixture component from Example 2.

Example 4

Measurement of the UV Transmission of Base Coat Layers

The water-borne coatings 3b and 3c were each applied to a quartz glass plate by means of electrostatically-assisted high-speed rotary atomization (in each case to a dry film thickness of 17 μm).

After 2 minutes flashing off at room temperature, the corresponding unmodified water-borne base coat 3a was pneumatically spray-applied in a 5 μm dry film thickness, flashed off for 5 minutes at 70° C. and baked for 15 minutes at 140° C.

Then, the UV transmission of the silica glass plates coated in this way with base coat layers was photometrically determined (uncoated silica glass plate in reference beam path; UV irradiation from the coated side).

The results are shown in Table 1.

TABLE 1

| | UV transmission in the wavelength range | | |
|---|---|---|---|
| | 280 to 380 nm | 380 to 400 nm | 400 to 450 nm |
| 3b + 3a | Between 0 and 0.02% | Between 0.02 and 0.11% | Between 0.11 and 0.66% |
| 3c + 3a | Between 0 and 0.08% | Between 0.08 and 1.02% | Between 1.02 and 2.11% |

The coating structure 3b+3a prepared making use of the black water-borne base coat from Example 1 allowed a UV transmission of only less than 0.1% in the wavelength range of from 280 to 380 nm, of less than 0.5% in the wavelength range of from 380 to 400 nm and of less than 1% in the wavelength range of from 400 to 450 nm. The coating structure 3c+3a prepared without making use of the black water-borne base coat from Example 1 exceeded that UV transmission limitation in the wavelength range of from 380 to 400 nm and in the wavelength range of from 400 to 450 nm.

What is claimed is:

1. A process for the production of multi-layer coatings in A' color shades, comprising the successive steps:

1) applying a two-layered base coat layer in a total process film thickness in the range from 10 to 35 μm to a substrate having an electrodeposition coating (EDC) primer coating, 2) applying a clear coat layer onto the base coat layer, 3) jointly curing the base coat and clear coat layers, wherein step 1) comprises (i) mixing 100 parts by volume (pbv) of an unmodified water-borne base coat A having a color shade A' and 1 to 150 pbv of an unmodified water-borne base coat B having a color shade B' to form an unmodified water-borne base coat AB, (ii) mixing the unmodified water-borne base coat AB with a pigment-free admixture component to form a modified water-borne base coat modAB, (iii) applying the first layer of the two-layered base coat layer from the modified water-borne base coat modAB and (iv) applying the second layer of the two-layered base coat layer from the unmodified water-borne base coat A, wherein the pigment-free admixture component is a composition with a solids content of 20 to 95 wt. % consisting of a resin solids content plus possible nonvolatile additives, said resin solids content consisting of polyisocyanate(s), and wherein the pigment-free admixture component is mixed into the unmodified water-borne base coat AB in a ratio by weight of 0.2 to 1 parts of polyisocyanate:1 part of resin solids of the unmodified water-borne base coat AB, and wherein the unmodified water-borne base coat B comprises one or more pigments which effectively reduces UV transmission and wherein the pigment content is such that UV light can penetrate through the base coat layer formed from modified water-borne base coat modAB and unmodified water-borne base coat A only in accordance with a UV transmission of less than 0.1% in the wavelength range of from 280 to 380 nm, of less than 0.5% in the wavelength range of from 380 to 400 nm and of less than 1% in the wavelength range of from 400 to 450 nm.

2. The process of claim 1, wherein the modified water-borne base coat modAB is applied in an individual process film thickness in the range from 5 to 25 μm and the unmodified water-borne base coat A is applied in an individual process film thickness in the range from 3 to 20 μm.

3. The process of claim 1, wherein the unmodified water-borne base coat B has a solid color shade.

4. The process of claim 3, wherein the unmodified water-borne base coat A has a solid color shade.

5. The process of claim 1, wherein the modified water-borne base coat modAB is applied by electrostatically-assisted high-speed rotary atomization and the unmodified water-borne base coat A is pneumatically spray-applied.

6. The process of claim 1, wherein the substrate is selected from the group consisting of automotive bodies and automotive body parts.

* * * * *